US006152057A

United States Patent [19]

Badillo

[11] Patent Number: 6,152,057

[45] Date of Patent: Nov. 28, 2000

[54] BOBBIN ASSEMBLY INCORPORATING A THREAD TENSIONING ASSEMBLY AND METHOD OF CONTROLLING THE PAYOUT OF THREAD FROM A BOBBIN ASSEMBLY

[75] Inventor: Paul Badillo, Littleton, Colo.

[73] Assignee: Bakron Corporation, Buffalo Grove, Ill.

[21] Appl. No.: 09/360,569

[22] Filed: Jul. 26, 1999

[51] Int. Cl.[7] ..... D05B 63/00

[52] U.S. Cl. ..... 112/229; 112/254

[58] Field of Search ..... 112/254, 185, 112/196, 229, 230, 231

[56] References Cited

U.S. PATENT DOCUMENTS

| | | | |
|---|---|---|---|
| 3,381,642 | 5/1968 | Bono | 112/229 |
| 4,275,675 | 6/1981 | Killinger | 112/229 |
| 4,679,513 | 7/1987 | Druffel | 112/229 |
| 4,884,519 | 12/1989 | Dreier | 112/229 |

FOREIGN PATENT DOCUMENTS

| | | | |
|---|---|---|---|
| 1063047 | 12/1957 | Germany | 112/229 |
| 2433797 | 1/1976 | Germany | 112/229 |

*Primary Examiner*—Ismael Izaguirre
*Attorney, Agent, or Firm*—Wood, Phillips, VanSanten, Clark & Mortimer

[57] ABSTRACT

The combination of a bobbin case assembly and a supply of thread. The bobbin case assembly has a wall structure defining a receptacle for the supply of thread and a thread tensioning assembly on the wall structure including a thread tensioning element. The supply of thread projects from the receptacle and is wrapped at least partially around the thread tensioning element so as to produce resistance to the removal of the thread from the receptacle.

21 Claims, 4 Drawing Sheets

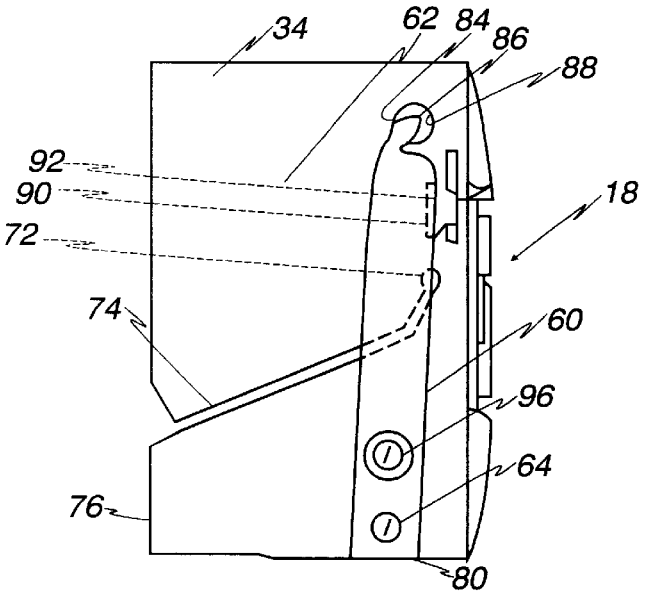
Fig. 3
(Prior Art)
Fig. 4
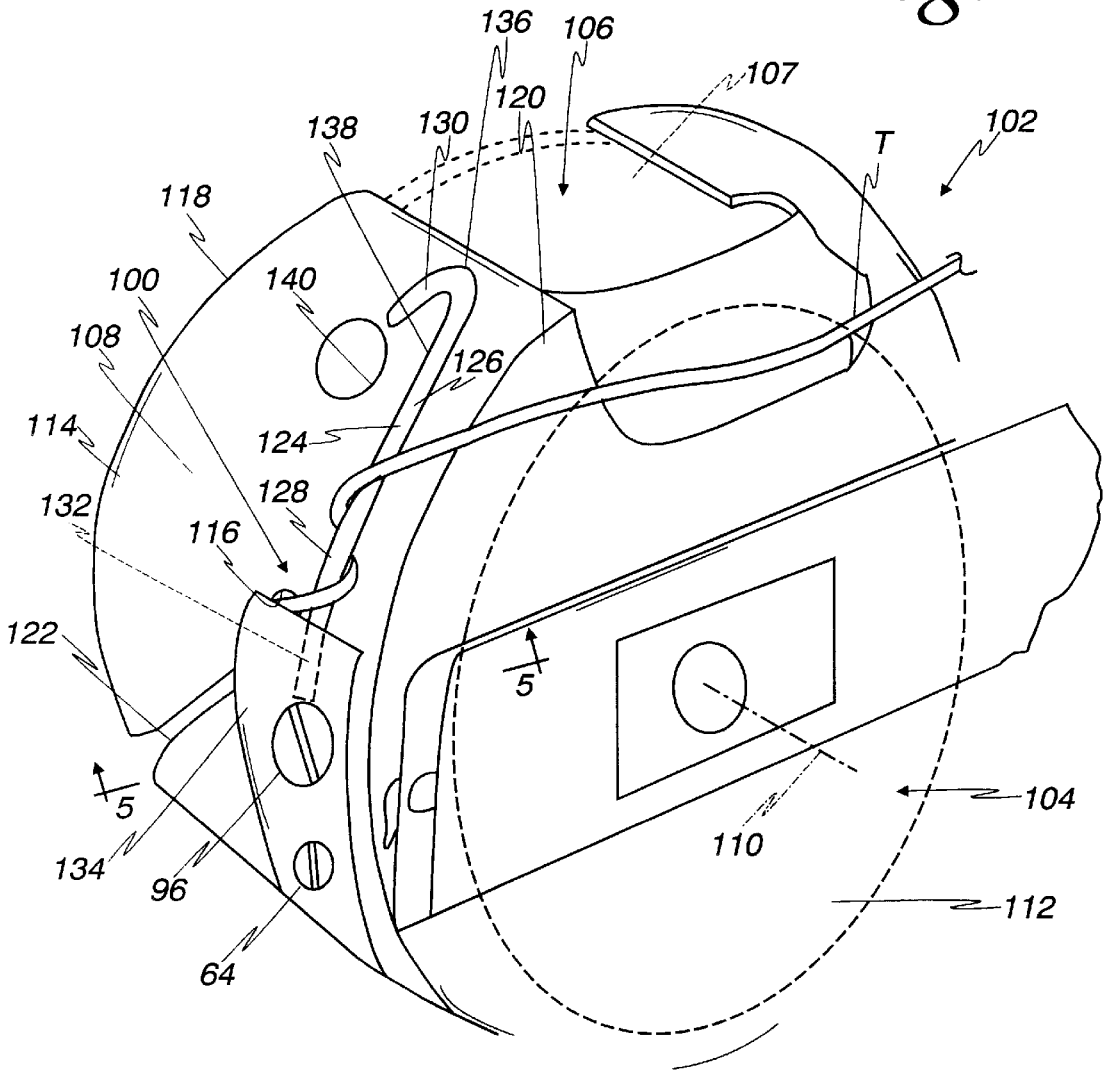

BOBBIN ASSEMBLY INCORPORATING A THREAD TENSIONING ASSEMBLY AND METHOD OF CONTROLLING THE PAYOUT OF THREAD FROM A BOBBIN ASSEMBLY

BACKGROUND OF THE INVENTION

1. Field of the Invention

This invention relates to stitching systems utilizing a bobbin from which thread is drawn and, more particularly, to a thread tensioning assembly used in conjunction with the bobbin which produces controlled resistance to the payout of thread from the bobbin.

2. Background of the Invention

In sewing operations, and particularly in embroidery sewing operations, the tension of two source components forming the lockstitch needle thread and bobbin thread must be balanced to achieve a high quality stitch. If the tension of the needle thread is significantly greater than the bobbin thread tension, the bobbin thread can be pulled from through the underside of the fabric and show at the top side of the fabric being sewn. This condition can cause puckering of the fabric or disfigured sewing to occur. If the needle thread tension is significantly less than the bobbin thread tension, loops can form on either side of the fabric and the stitch formation can appear loose or distortedly large.

A primary job of the sewing equipment operator is to keep bobbin and needle thread tensions as close as possible to balanced. The method of balancing thread tension has historically been carried out by having the sewing operator observe the sewing pattern after stitches are laid down. Good sewing operators constantly adjust the tension of both needle and bobbin threads to maintain the proper balance. Less skilled operators may not consistently maintain this balance as a result of which poor quality stitch formation may result.

The task of balancing tensions is further complicated by the inherent problems of conventional sewing hooks and bobbin cases. The "all steel" hook construction requires oil to maintain cool and consistent rotation. However, it is unavoidable that hook rotation becomes inconsistent because the oil can dissipate from the hook raceway track as a result of which friction between the bearing surfaces of the bobbin basket and hook raceway increases. In a typical operating shift, the all steel hook construction may enter a "stick-slip" cycle, which is triggered by friction. When the hook sticks, maintenance of good stitch formation requires that the operator tighten the needle thread tension for the loop to be pulled past the thread escape exit and up into the fabric being sewn. If the tension is not tightened during the stick mode, loops may form on the material being sewn. After the tightening adjustment is implemented, the "slip" mode can return. However, the previous tightening adjustment of needle thread tension may cause the tension to be too tight for the current "slip" condition. As a result, puckering of the fabric or bobbin thread coming through the top of the fabric may occur. The operator thus must continuously monitor the thread tension balance brought about by the "stick-slip" cycle.

It has been observed that the "stick-slip" cycle tends to cause the thread tension balance point to progressively migrate upwards as the operator tightens needle thread tension to compensate for the "stick mode". Often the operator tries to strike the proper balance by tightening the bobbin case spring to reduce the rate of bobbin spooling. The net effect is the equilibrium balance point creeps to a higher tension for both needle and bobbin threads. The higher equilibrium point is detrimental to sewing performance because higher tension, even if balanced, may cause increased incidence of thread breakage and puckering. Higher tensions cause thread to pucker the fabric as it assumes its reflexive state. Lower tension at equilibrium is optimal because thread is less vulnerable to breakage from sharp burrs, edges, or interruptions along the thread path.

The monitoring task becomes even more burdensome in embroidery where the operator is responsible for multi-head machines often having from 15 to 20 sewing heads per machine and 9 to 12 needles per head. The embroidery machine often has 3 tension gauges per needle. Therefore, the operator may be responsible for 720 needle tension gauges per machine for a 20-head, 12-needle machine. It is virtually impossible for the operator to regulate this many variables to achieve thread tension balance for optimal stitch formation.

The task of balancing needle thread with bobbin thread can be further complicated by the variation of the bobbin case settings. Presently the bobbin is placed in the bobbin case and thread routed between the side wall and bobbin case spring. The conventional bobbin case has a regulator screw that increases or decreases the spring pressure to affect the spooling of the bobbin thread. The operator is taught to set the regulator screw to a pressure that allows the bobbin to spool a predetermined number of inches when he/she lets the bobbin case drop, using a slight jerk of the wrist. Unfortunately this is not a precise and quantifiable procedure and the bobbin spring tension settings tend to vary greatly. Often during the course of a month, week, day, or even embroidery run, the bobbin case spring can lose tensile strength or flex.

The setting of the bobbin case tension is the first procedure for correctly balancing thread tension. While it was shown above that there could be several hundreds of settings for adjusting needle thread tension, there is only one bobbin case setting per sewing head. All needle thread balancing is calibrated based on a definitive and stable bobbin case setting. Once the proper bobbin case setting is made, all balancing between the needle thread and bobbin thread tensions is implemented from the needle thread tension gauges.

If the bobbin thread tension varies throughout its run or after its changing, the required adjustment of the large number of needle tension gauges goes up exponentially. An operator cannot react effectively to the constantly changing needle thread tension and bobbin thread tension combinations.

SUMMARY OF THE INVENTION

In one form, the invention is directed to the combination of a bobbin case assembly and a supply of thread. The bobbin case assembly has a wall structure defining a receptacle for the supply of thread and a thread tensioning assembly on the wall structure including a thread tensioning element. The supply of thread projects from the receptacle and is wrapped at least partially around the thread tensioning element so as to produce resistance to the removal of the thread from the receptacle.

In one form, the receptacle has a central axis and the wall structure includes a peripheral wall extending around the central axis and an outer wall surface facing radially outwardly relative to the central axis. The thread tensioning element is disposed at least partially radially outside of the outer wall surface of the peripheral wall.

The thread tensioning element may be mounted on the peripheral wall.

The thread tensioning element may be cantilever mounted to the wall structure.

In one form, the thread tensioning element has a substantially straight, elongate body.

The thread tensioning element may be made from a piece of wire. The outer surface of the wire may be polished to control frictional characteristics.

In one form, the thread tensioning element has a mounting end that is attached to the wall structure and a free end, with the thread tensioning element being U-shaped at the free end.

The thread may be wrapped through at least 360° around the thread tensioning element.

In one form, at least part of the thread tensioning element, between the mounting end and the free end, does not abut to the outer wall surface.

The mounting end may be captively maintained against the peripheral wall.

In one form, a portion of the thread tensioning element adjacent the free end abuts to the outer wall surface.

The invention is also directed to a bobbin case assembly with a wall structure defining a receptacle for a supply of thread and a thread tensioning assembly on the wall structure including a thread tensioning element. The thread tensioning element is configured so that thread from the receptacle can be wrapped at least partially around the thread tensioning element so that as thread is drawn out of the receptacle and over the thread tensioning element, resistance is produced to removal of thread from the receptacle.

The invention is also directed to the combination of a support defining a receptacle for a bobbin carrying a supply of thread, with the receptacle having a central axis, and a thread tensioning assembly. The support has a wall with an opening through which thread on the bobbin can be drawn through the wall radially outwardly from the central axis. The thread tensioning assembly includes a thread tensioning element. The thread is wrapped at least partially around the thread tensioning element to produce resistance to drawing of thread through the opening from the bobbin.

The invention is also directed to a method of controlling the payout of thread from a bobbin in a receptacle bounded by a wall and having an associated thread tensioning assembly with a thread tensioning element. The method includes the steps of: directing thread from the bobbin to outside of the receptacle; outside of the receptacle, wrapping the thread at least partially around the thread tensioning element; and drawing the thread against the thread tensioning element as the thread is drawn out of the receptacle.

BRIEF DESCRIPTION OF THE DRAWINGS

FIG. 3 is a side elevation view of the bobbin case assembly of FIGS. 1 and 2;

FIG. 4 is a perspective view of a bobbin case assembly incorporating a thread tensioning assembly, with a thread tensioning element, according to the present invention;

DETAILED DESCRIPTION OF THE DRAWINGS

Figure 1:
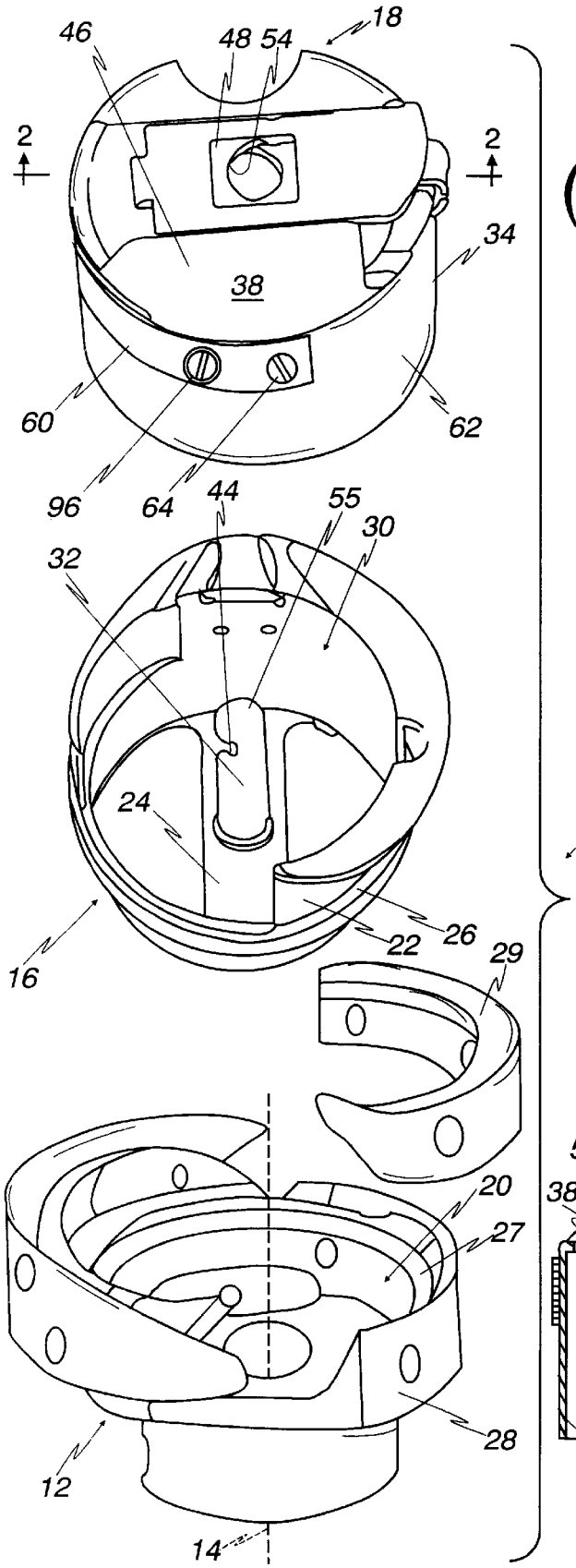
Fig. 1 (Prior Art)
FIG. 1 is an exploded, perspective view of a conventional stitching system including a hook assembly, a bobbin basket assembly, and a bobbin case assembly.
Figure 2:
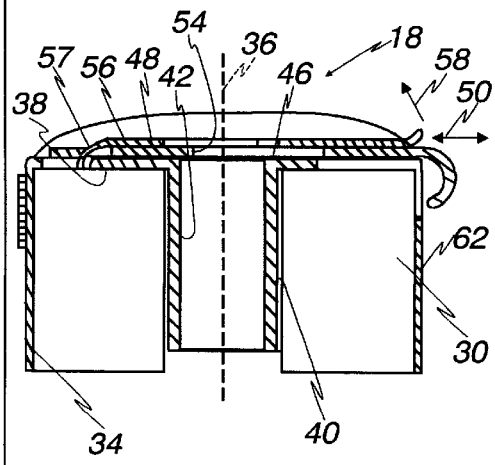
Fig. 2 (Prior Art)
FIG. 2 is a cross-sectional view of the bobbin case assembly taken along line 2—2 of FIG. 1.

In FIGS. 1–3 therefor, a conventional rotary hook system, suitable for incorporation of the present invention, is shown at 10. The rotary hook system 10 consists of a hook assembly at 12 having an operating axis 14, a bobbin basket assembly at 16, and a bobbin case assembly at 18.

The bobbin basket assembly 16 is mounted in a receptacle 20 defined by the hook assembly 12. The hook assembly 12 is guided in movement relative to the bobbin basket assembly 16 around the axis 14. The bobbin basket assembly 16 has a peripheral wall 22 extending upwardly from a bottom wall 24 and a curved bearing rib 26 projecting radially outwardly from the peripheral wall 22. The bearing rib 26 moves in a raceway 27 defined by the hook assembly 12, and bounded by a main body 28 and a separable gib element 29, to guide relative rotational movement between the hook assembly 12 and bobbin basket assembly 16.

The peripheral wall 22 on the bobbin basket assembly 16 bounds a receptacle 30 for a thread carrying bobbin (not shown). The bobbin is supported for rotation on a center post 32 projecting upwardly from the bottom wall 24 and through the bobbin.

The receptacle 30 is dimensioned to also receive the bobbin case assembly 18. The bobbin case assembly 18 has a peripheral wall 34 extending around a central axis 36 that is coincident with the axis 14 with the bobbin case assembly 18, bobbin basket assembly 16, and hook assembly 12 operatively connected to each other. A generally radially extending confining wall 38 spans the top of the peripheral wall 34. The bobbin basket assembly 16 and bobbin case assembly 18 cooperatively define the bobbin receptacle 30.

A sleeve 40 depends from the confining wall 38 and has a through opening 42 to closely receive the center post 32. With the bobbin case assembly 18 within the receptacle 30 and operatively connected to the bobbin basket assembly 16, the center post 32 projects through the through opening 42 sufficiently that a notch 44 thereon is exposed above a part of the upper surface 46 of the confining wall 38. The notch 44 could be at axial locations other than that shown.

A latch system includes a latch element 48 mounted on top of the confining wall 38 for guided translatory movement in the line of the double-headed arrow 50. The latch element 48 is normally spring biased towards a latched position shown in FIGS. 1 and 2, wherein a curved locking rim 54 on the latch element 48 moves into radially overlapping relationship with the through opening 42. By directing the center post 32 into the through opening 42, a rounded head 55 on the center post 32 acts against the locking rim 54 and progressively cams the latch element 48 from right to left in FIGS. 1 and 2. With the bobbin case assembly 18 fully seated in the receptacle 30, the notch 44 on the center post 32 aligns axially with the locking rim 54. The spring biased latch element 48 then shifts into the notch 44 to fix the axial relationship between the bobbin basket assembly 16 and bobbin case assembly 18.

When it is desired to separate the bobbin case assembly 18 from the bobbin basket assembly 16, an actuator 56 on the latch system, having an offset end 57 extending through the latch element 48, is pivoted in the direction of the arrow 58, as an incident of which the latch element 48 is driven from right to left in FIG. 2 to an unlatched position, wherein the locking rim 54 is moved out of the notch 44, thereby allowing axial separation of the bobbin basket assembly 16 and bobbin case assembly 18.

The bobbin case assembly 18 further has a thread holding spring tensioning element 60 thereon. The spring element 60 is curved and wraps around a part of the outer surface 62 of the peripheral wall 34 of the bobbin case assembly 18. The spring element 60 is maintained on the peripheral wall 34 by a screw fastener 64.

As seen in FIG. 3, the peripheral wall 34 has a thread receiving opening 72 therethrough. A slot 74 extends through the peripheral wall 34 from one axial end 76 of the peripheral wall in an L shape up to the thread receiving opening 72.

The spring element 60 has a curved shape and is attached to the outer surface 62 of the peripheral wall 34 so as to at least partially overlie the thread receiving opening 72 and a portion of the slot 74. The spring element 60 has a first end 80 attached to the outer surface 62 of the peripheral wall 70 through the screw fastener 64. The opposite end 84 of the spring element 60 has an offset finger 86 which projects into an opening 88 in the peripheral wall 34 in such a manner that the spring element 60 bears on the edge bounding the opening 88 to confine axial movement of the spring end 84 relative to the peripheral wall 34. A second offset finger 90 on the spring element 60 projects into a slot 92 in the peripheral wall 34 likewise to consistently locate the spring element 60 and prevent axial shifting thereof relative to the peripheral wall 70.

Thread projecting from the thread receiving opening 72 resides between the spring element 60 and the outer surface 62 of the peripheral wall 34 therefor. Spacing between the spring element 60 and the outer surface 62, and thus the captive pressure applied on the thread, can be varied by an adjusting screw 96. The amount of tension generated is determined generally on a trial and error basis, as noted above. That is, the user sets the adjustment screw 96 to select an estimated tension on the thread and then either pulls on the thread while holding the bobbin case assembly 18, or thrusts the bobbin case assembly 18 while holding the thread. By these procedures, the user can roughly ascertain whether the desired tension has been set. Appropriate adjustment can then be made with a repetition of the same trial and error procedure.

Figure 5:
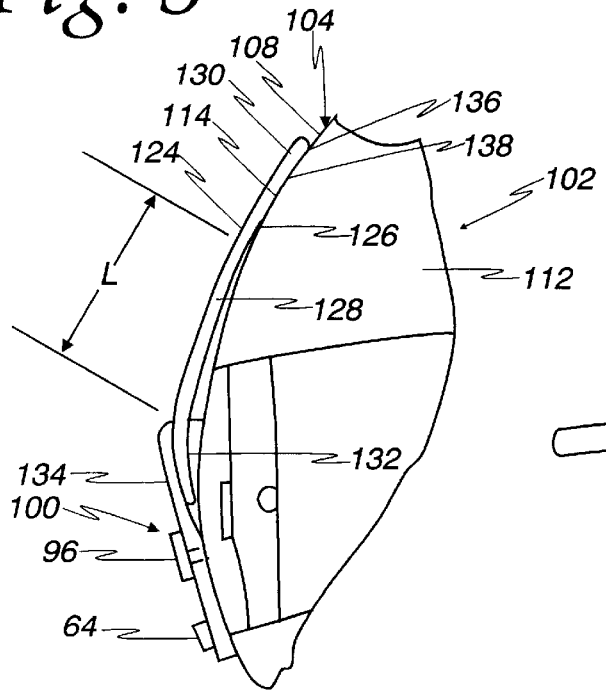
FIG. 5 is a fragmentary, cross-sectional view of the bobbin case assembly taken along line 5—5 of FIG. 4.

In FIGS. 4 and 5, a thread tensioning assembly, according to the present invention, is shown at 100, incorporated into a conventional bobbin case assembly 102, essentially having the configuration as the bobbin case assembly 18, described with respect to FIGS. 1–3. Thus, details of the structure peripheral to the thread tensioning assembly 100 will not be described hereinbelow.

The bobbin case assembly 102 has a wall structure 104 defining a receptacle 106 within which a supply of thread T can be stored on a bobbin 107. The wall structure 104 includes a peripheral wall 108 extending around a central axis 110, for the receptacle 106 and a confining wall 112. The peripheral wall 108 has an outer wall surface 114 on which the tensioning assembly 100 is mounted.

A thread receiving opening 116 is provided through the peripheral wall 108 approximately midway between the axial ends 118, 120 of the peripheral wall 108. This location of the thread receiving opening 116 provides good thread spooling and may account for reduced localized thread wear. A slot 122 extends through the peripheral wall from the axial end 118 to the thread receiving opening 116.

The tensioning assembly 100 consists of a tensioning element 124, in this embodiment in the shape of an elongate hook. The tensioning element 124 has a body 126 with a substantially straight portion 128 which extend around the axis 116 terminates at a U-shaped bend 130, so that the body 126 has an overall "J" shape N.E. 121.

One end 132 of the body 126 is a mounting end. The mounting end 132 is captive between a mounting plate 134 and the outer wall surface 114. The mounting plate 134 can be bored to receive the fastener screws 64, 96, previously described, using the pre-threaded openings therefor. The mounting end 132 could be glued or welded in place, or held by any other means i.e. by a press fit mechanism, etc.

In a preferred form, the body 126 of the tensioning element 124 does not contact the outer wall surface 114 over a substantial length L thereof between the mounting end 132 and the opposite free end 136. It is contemplated that the thread T from the thread receiving opening 116 can be wrapped at least partially around the body 126 in the region where the body 126 is spaced radially outwardly therefrom the outer wall surface 114. With this arrangement, the thread T does not have to be captively held against any part of the bobbin case assembly 102, including the tensioning assembly 100. Instead, the tension is produced by the friction between the thread T and the outer surface 138 around which the thread T is wrapped.

The degree of tension can be varied by changing the degree of wrapping, i.e. by extending the thread T from only partially around the body 126 through multiple turns around the body 126, and also by varying the characteristics of the outer surface 138 of the body 126. As an example, a single wrap may produce light tension, with three wraps producing a relatively heavy tension. The outer surface 138 may be polished, with the degree of polishing dictating the frictional coefficient between the thread T and the outer surface 138.

The U-shaped bend 130 prevents the thread T from inadvertently sliding off of the free end 136 of the tensioning element 124. While the free end 136 of the tensioning element 124 is in contact with the outer wall surface 114, the free end 136 could be spaced therefrom without impairing operation of the tensioning assembly 100. With this arrangement, the free end 136 does not need to be precisely located as in the prior art. Thus, the opening 140, corresponding to the opening 88, previously described with respect to FIG. 3, can be eliminated.

Figure 7:
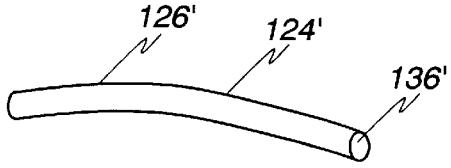
FIG. 7 is a perspective view of a modified form of tensioning element for the inventive thread tensioning assemblies in FIGS. 3–6.

While preferably the body 126 has a substantially straight shape over a substantial extent between the ends 132, 136 thereon, the body 126 could be formed with a slight curvature, as seen for the tensioning element 124' in FIG. 7. The body 126' of the tensioning element 124' does not have a U-shaped bend 130 at the end 136' thereon as in the prior embodiment. The U-shaped bend is optional in all embodiments.

Figure 8:
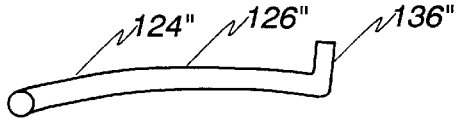
FIG. 8 is a further modified form of thread tensioning element according to the present invention.

In FIG. 8, a further modified form of tensioning element is shown at 124" wherein the body 126" is shown curved and terminating in an offset end 136 therefor that produces an L shape.

Still further, the tensioning element could have an overall "T" shape or have a closed loop formed thereon. As a further alternative, the tensioning element could have a zig zag portion around which the thread T is wrapped.

Many other variations of the overall shape and shape of the free end are contemplated by the invention. The primary limitation on the configuration is that the tensioning element 124, 124', 124" be configured so as to allow thread T to be wrapped partially or with multiple turns therearound to develop the desired tension through frictional control as the thread is drawn thereover in operation. At the same time, the configuration should lend itself to introduction of the thread T around the tensioning element 124, 124', 124". This may be accomplished by directing thread T directly into the space at the region of the tensioning element 124, 124', 124" that is spaced from the outer wall surface 114. Alternatively, the free end 136, 136', 136" can be deflected radially outwardly to allow the thread T to be properly placed.

The selection of the particular diameter of the material making up the tensioning element 124, 124', 124" is affected principally by two factors. First, by increasing the diameter, the frictional forces generated perwrap can be increased. Also, the diameter determines the flexibility of the tensioning element 124, 124', 124".

The tensioning element is preferably made from metal, such as piano wire, or the like, but could be made from plastic or other material capable of withstanding the forces produced in operation.

It is contemplated that the inventive concept can be used in any structure in which tension is required to be controlled on thread paying out from a supply thereof. The generic inventive concept is shown in FIG. 6 wherein a bobbin 144 for thread T is shown on a support 146 having a peripheral wall 148 at least partially bounding a receptacle 150 for the bobbin 144, and in which thread T is drawn off by any suitable thread drawing mechanism 152.

That is, it is unimportant whether there is a separate hook assembly, bobbin basket, bobbin case, and bobbin or whether the functions of one or more of these elements are combined. It is only necessary that there be some support for the bobbin 144 carrying thread T that is being paid out under the force of a thread drawing mechanism 152 through a peripheral wall 148 thereon.

Figure 6:
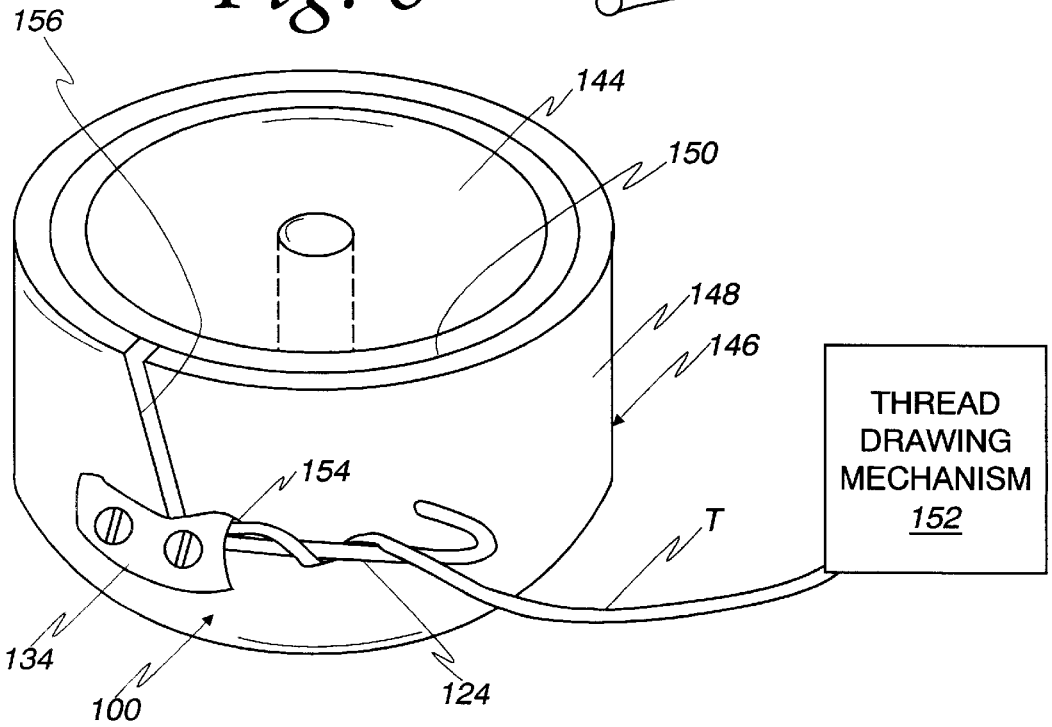
FIG. 6 is a perspective view showing generically a system for storing a supply of thread and drawing thread from the supply with a thread tensioning assembly, according to the present invention, incorporated therein.

In FIG. 6, the thread tensioning assembly 100 is configured as in FIG. 4, with the thread tensioning element 124 having a hook shape and maintained through a mounting plate 134 upon the peripheral wall 148 in the vicinity of a thread receiving opening 154, which is contiguous with a slot 156 through the peripheral wall 148.

Figure 9:
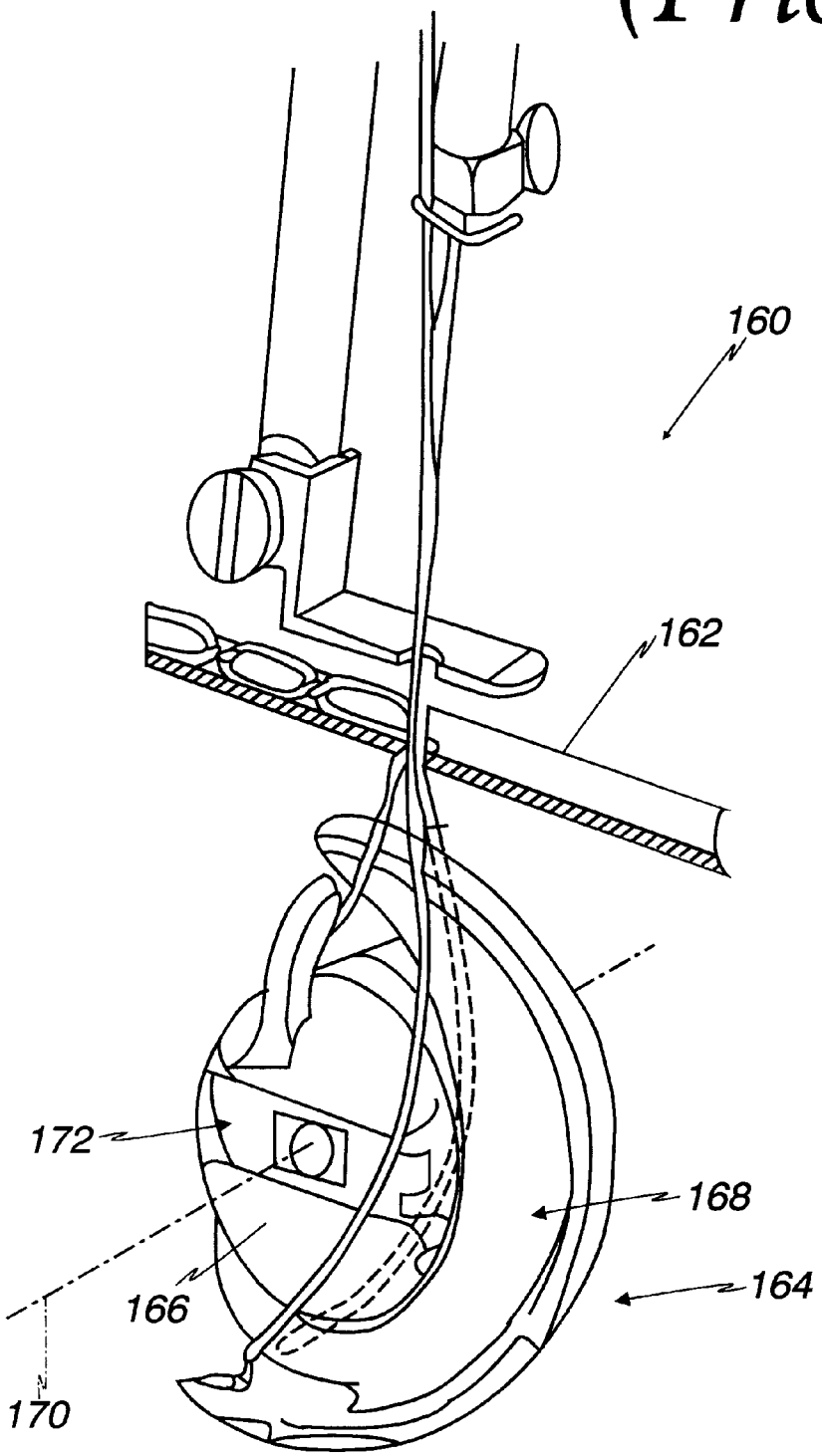
Fig. 9 (Prior Art)
FIG. 9 is a fragmentary, perspective view of a sewing machine with a shuttle-type hook system, into which the thread tensioning assembly, according to the present invention, can be incorporated.

The invention is not limited to a rotary system and is similarly operable as part of a shuttle-type system as shown, for example, in FIG. 9. In FIG. 9, a part of a sewing machine is shown at 160 in the process of stitching a piece of material 162. The shuttle-type hook system at 164 has a bobbin case assembly 166 incorporated therein and mounted to a hook assembly 168. The hook assembly 168 is movable in an oscillatory path relative to the bobbin case assembly 166 around an axis 170. The operation of this type of hook system 164 is described more fully in my co-pending application Ser. No. 09/010,888, which is incorporated hereby reference. A latch system 172, of the type previously described, is used.

Using the present invention, a number of problems with prior art systems, of the type shown in FIGS. 1–3, may be overcome. The spring element 60 defines in conjunction with the peripheral wall 78 a natural receptacle for lint and other foreign matter. With a significant buildup of lint, spooling of the bobbin thread from the bobbin case may be affected. By reason of the tensioning elements' 124, 124', 124" having the configuration shown, or made in other configurations to function in the same manner, there may be a lesser tendency of lint and other foreign material to be captured and accumulated during system operation.

By controlling the degree of wrapping around the tensioning elements, frictional characteristics and thus tension, can be consistently and predictably selected over a significant range. This may eliminate the chances for human error at setup and the oft times rigorous monitoring requirements during operation.

The problems associated with spring fatigue in conventional systems may be obviated since the frictional characteristics may not vary significantly, even after the tensioning element deforms after use. Instead, tension is determinable, quite accurately, by the degree of wrapping.

Further, the thread wrapped around the tensioning elements is not prone to separating from the tensioning element, whereas in the existing systems using a captive spring arrangement, this is more likely to occur.

Generally, stable tensioning conditions may be maintained, potentially avoiding the aforementioned variation in thread tension equilibrium level.

The foregoing disclosure of specific embodiments is intended to be illustrative of the broad concepts comprehended by the invention.

What is claimed is:

1. In combination:

a) a bobbin case assembly comprising:

a wall structure defining a receptacle for a supply of thread, the receptacle having a central axis; and a thread tensioning assembly on the wall structure comprising a thread tensioning element, said thread tensioning element comprising wire having at least a portion thereof with a length that extends around the central axis; and b) a supply of thread in the receptacle, projecting from the receptacle, and wrapped at least partially around the tensioning element so as to produce resistance to the removal of the thread from the receptacle.

2. The combination according to claim 1 wherein the wall structure comprises a peripheral wall extending around the central axis and an outer wall surface facing radially outwardly relative to the central axis, and the thread tensioning element is disposed at least partially radially outside of the outer wall surface of the peripheral wall.

3. The combination according to claim 2 wherein the thread tensioning element is mounted on the peripheral wall.

4. The combination according to claim 1 wherein the thread tensioning element is cantilever mounted to the wall structure.

5. The combination according to claim 1 wherein the thread tensioning element comprises a substantially straight, elongate body.

6. The combination according to claim 1 wherein the wire has an outer surface around which the thread is wrapped that is polished to control frictional characteristics.

7. The combination according to claim 4 wherein the thread tensioning element has a mounting end that is attached to the wall structure and a free end, and the thread tensioning element is U-shaped at the free end.

8. The combination according to claim 4 wherein the thread tensioning element has a mounting end that is attached to the wall structure and a free end, and at least part of the tensioning element between the mounting end and free end does not abut to the outer wall surface.

9. The combination according to claim 4 wherein the thread tensioning element has a mounting end and a free end and the mounting end is captively maintained against the peripheral wall.

10. The combination according to claim 7 wherein a portion of the thread tensioning element adjacent the free end abuts to the outer wall surface.

11. In combination:

a) a bobbin case assembly comprising:

a wall structure defining a receptacle for a supply of thread; and a thread tensioning assembly on the wall structure comprising a thread tensioning element and b) a supply of thread in the receptacle, projecting from the receptacle, and wrapped at least partially around the tensioning element so as to produce resistance to the removal of the thread from the receptacle, wherein the thread is wrapped through at least 360° around the thread tensioning element.

12. A bobbin case assembly comprising:

a wall structure defining a receptacle for a supply of thread, the receptacle having a central axis; and a thread tensioning assembly on the wall structure comprising a thread tensioning element, the thread tensioning element comprising a body with an elongate portion having a convex outer surface, extending around the central axis, and configured so that thread from the receptacle can be wrapped at least partially around the elongate portion of the body of the thread tensioning element so that as thread is drawn out of the receptacle and over the tensioning element, resistance is produced to removal of the thread from the receptacle.

13. The bobbin case assembly according to claim 12 wherein the receptacle has a central axis, the wall structure comprises a peripheral wall extending around the central axis and an outer wall surface facing radially outwardly relative to the central axis, the thread tensioning element is disposed at least partially radially outside of the outer wall surface of the peripheral wall, and the length of the elongate portion extends around the central axis.

14. The bobbin case assembly according to claim 13 wherein the thread tensioning element is mounted on the peripheral wall.

15. The bobbin case assembly according to claim 12 wherein the thread tensioning element is cantilever mounted to the wall structure.

16. The bobbin case assembly according to claim 12 wherein the thread tensioning element comprises a substantially straight, elongate body.

17. The bobbin case assembly according to claim 12 wherein the thread tensioning element comprises a piece of wire.

18. The bobbin case assembly according to claim 15 wherein the thread tensioning element has a mounting end that is attached to the wall structure and a free end, and the thread tensioning element is U-shaped at the free end.

19. The bobbin case assembly according to claim 18 wherein a portion of the thread tensioning element adjacent the free end abuts to the outer wall surface.

20. In combination:

a support defining a receptacle for a bobbin carrying a supply of thread, with the receptacle having a central axis, the support having a wall with an opening through which thread on the bobbin can be drawn through the wall radially outwardly from the central axis; and a thread tensioning assembly on the support and comprising a thread tensioning element with a central axis, the thread wrapped at least partially around the thread tensioning element to produce resistance to drawing of thread through the opening from the bobbin, the thread tensioning element comprising a portion with a convex outer surface extending around the central axis of the thread tensioning element, the central axis of the portion of the thread tensioning element being non-parallel to the central axis of the receptacle.

21. A method of controlling the payout of thread from a bobbin in a receptacle with a central axis and bounded by a wall and having an associated thread tensioning assembly with a thread tensioning element, said method comprising the steps of:

directing thread from the bobbin to outside of the receptacle;

outside of the receptacle wrapping the thread at least partially around the thread tensioning element in a spiral around a first axis; and drawing the thread against the thread tensioning element in a spiral path around the first axis that is non-parallel to the central axis as the thread is drawn out of the receptacle.

* * * * *